United States Patent [19]

Choon

[11] Patent Number: 5,059,870

[45] Date of Patent: Oct. 22, 1991

[54] ELECTRONIC SOLID STATE STARTER FOR FLUORESCENT LAMPS

[76] Inventor: Chung Y. Choon, Boeun Jutaek Ga Dong 101, 933-1-, Shinwol 4 Dong, Yangcheon-Ku, Seoul, Rep. of Korea

[21] Appl. No.: 366,478

[22] Filed: Jun. 15, 1989

[30] Foreign Application Priority Data

Jan. 24, 1989 [KR] Rep. of Korea ..... 700

[51] Int. Cl.[5] ..... H05B 41/14

[52] U.S. Cl. ..... 315/289; 315/290; 315/101; 315/106; 315/DIG. 5

[58] Field of Search ..... 315/101, 106, 289, 290

[56] References Cited

U.S. PATENT DOCUMENTS

| | | | |
|---|---|---|---|
| 4,513,227 | 4/1985 | Labadini et al. | 315/290 |
| 4,749,909 | 6/1988 | Smulders | 315/106 |

FOREIGN PATENT DOCUMENTS

| | | | |
|---|---|---|---|
| 0004672 | 1/1977 | Japan | 315/289 |
| 0018078 | 2/1977 | Japan | 315/289 |
| 0019481 | 2/1977 | Japan | 315/290 |
| 0010584 | 1/1979 | Japan | 315/290 |
| 1592225 | 7/1981 | United Kingdom | 315/101 |

*Primary Examiner*—Eugene R. LaRoche
*Assistant Examiner*—Son Dinh
*Attorney, Agent, or Firm*—Jones, Tullar & Cooper

[57] ABSTRACT

An electronic starter for fluorescent lamps is disclosed. A Triac having a trigger electrode and having an anode and a cathode connectable to first and second filaments, respectively, of a fluorescent lamp is provided. A thermistor, a resistor, and a capacitor are connected in series across the anode and the cathode of the Triac, and a voltage responsive element, such as a bipolar Zener diode, is connected between the trigger electrode of the Triac and the junction between the resistor and the capacitor. This starter replaces conventional glow starters for fluorescent lamps, without requiring a special ballast.

4 Claims, 2 Drawing Sheets

ELECTRONIC SOLID STATE STARTER FOR FLUORESCENT LAMPS

BACKGROUND OF THE INVENTION

The present invention is directed to an improved electronic starter for fluorescent lamps, and more particularly to a solid state starter circuit which will replace conventional glow starters without requiring a special ballast.

The glow starters conventionally used with fluorescent lamps have numerous disadvantages. For example, such starters require a long time to warm up and to glow after the power switch is turned on, and this is particularly a problem in cold weather. In addition, such starters also cause interference with radios and other communication devices due to the sparking noises generated during operation. In attempts to overcome these problems various types of non-glowing electronic starters have been developed in the past, but they have been unfit for direct connection to the circuit wiring present in existing fluorescent lamps. Furthermore, the use of such starters has been limited to small lamps of six to ten watts. Such prior non-glowing electronic starters have required an inductor and/or a capacitor with a large capacity in proportion to the lamp power because they required a special ballast transformer, Triac, and an LC oscillator circuit. Because such prior art devices were incompatible both in size and in circuit connections with conventional lamps using glow starters, if it was desired to use such devices it was necessary to limit their use to small lamps and to provide separate connections for them.

Some non-glowing electronic starters were able to provide rapid starting of fluorescent lamps through the use of harmonic oscillations. However, such devices shorten the life of the lamp filament and the high cost of such devices inhibited wide usage.

SUMMARY OF THE INVENTION

The present invention provides an economical electronic starter for fluorescent lamps which is capable of being freely interchanged with conventional glow starters by enclosing the present circuit in a container of an identical size and shape as the container which is used with prior conventional glow-starters.

The present invention employs a Triac having a trigger electrode, and having an anode and a cathode. The anode and cathode are connected to the lighting circuit of a fluorescent lamp, while a voltage switching element such as a Zener diode or a Diac are connected to the trigger electrode of the Triac. A positive thermistor and a time-constant circuit such as an RC circuit form a triggering network which is coupled to the trigger electrode. When the positive thermistor is heated by current flow in the circuit so that its resistance becomes greater, the trigger angle of the Triac, which is controlled by the signal produced by the time-constant circuit is varied. The trigger signal causes the Triac to suddenly cut off at a selected voltage below the self-maintenance current of the Triac, producing a reactive voltage at both ends of the fluorescent lamp. The time at which the signal occurs changes as the thermistor heats, causing the reactive voltage to increase at each cycle of the AC power until the reactive voltage is sufficient to turn the lamp on.

BRIEF DESCRIPTION OF THE DRAWINGS

The foregoing and additional objects, features and advantages of the invention will become apparent to those of skill in the art from a consideration of the following detailed description of a preferred embodiment thereof, taken in conjunction with the accompanying drawings, in which.

DESCRIPTION OF PREFERRED EMBODIMENT

Figure 1:
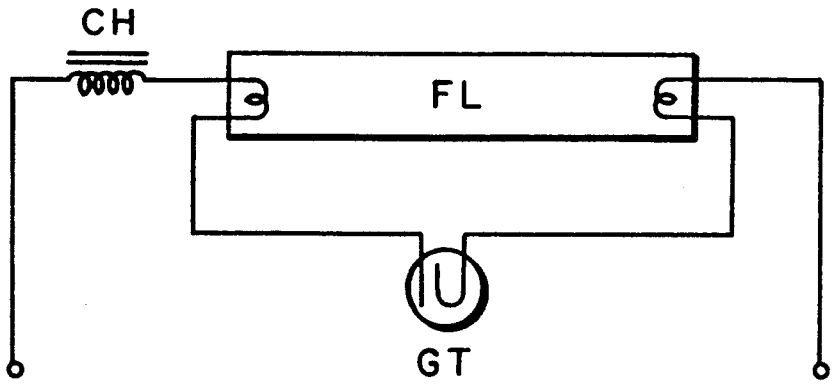
FIG. 1 is a schematic diagram of a conventional glow-type starter circuit for a fluorescent lamp.

FIG. 1 illustrates a conventional fluorescent tube starter circuit wherein the tube FL includes a pair of filaments connected in series with a ballast or choke coil OH and a glow starter GT, with the series circuit being connected across an AC source. The glow starter GT typically is furnished in a container having a pair of connector pins so that the starter can be easily connected into the lamp circuit and is easily replaceable.

Figure 2:
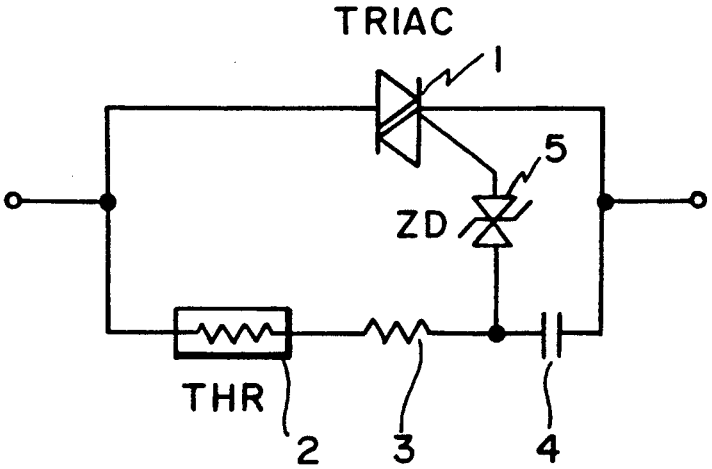
FIG. 2 is a circuit diagram of the starter circuit of the present invention.

The present invention is directed to a starter circuit such as that illustrated in FIG. 2 and which fits in a container connectable in the lamp circuit in the same manner as the conventional glow starter. The circuit of FIG. 2 incorporates a Triac having anode and cathode terminals T1 and T2 (FIG. 3) and having a control electrode, or gate terminal T3. One side of a positive thermistor 2, the resistance of which increases as the temperature of the thermistor increases, is connected to the anode terminal T1 of Triac 1, with the other end of the thermistor being connected in series with a resistor 3 and a capacitor 4 to the cathode terminal T2 of the Triac. The junction between resistor 3 and capacitor 4 is connected through a voltage switching element 5 to the gate T3 of Triac 1. The voltage switching element 5 consists of a bipolar Zener diode, a Diac or other bidirectional AC switching device having on and off states for positive and negative voltages. The other side of the capacitor is connected to the cathode of the Triac at terminal T2.

Figure 3:
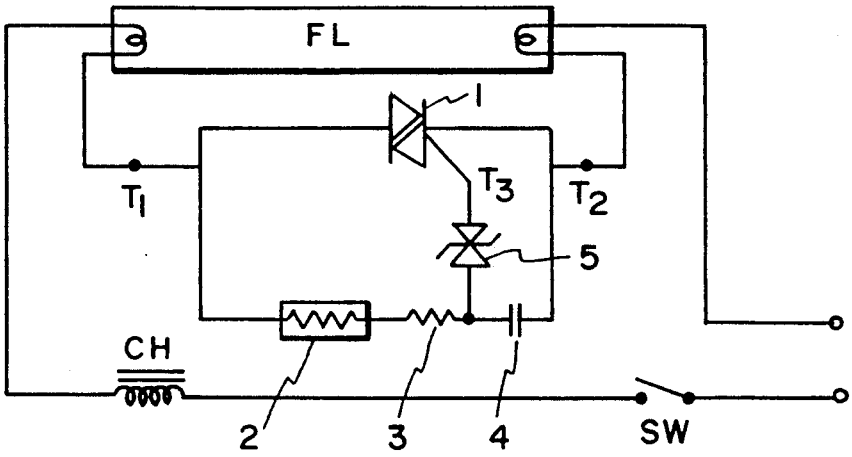
FIG. 3 is a circuit diagram of the starter circuit of the present invention connected to a fluorescent lamp.

As illustrated in FIG. 3, the anode and the cathode of the Triac 1 are connected by way of terminals T1 and T2 to the filaments at opposite ends of the fluorescent tube FL. The filaments and the starting circuit are connected in series with a choke OH and an on-off switch SW, with the series circuit being connected across an AC source. When switch SW is closed, capacitor 4 is charged through the choke CH and through the positive thermistor 2 and resistor 3. The gate of Triac 1 is triggered by the switching element 5 at a time in each half cycle of the AC power when the capacitor 4 becomes charged above a set voltage value. When the Triac is triggered, it begins to conduct to allow current to flow through the filaments at both ends of the fluorescent tube FL, thereby heating the filaments.

The Triac is triggered on and off in each half cycle of the AC power supplied to the fluorescent lamp, with the time in each half cycle at which the thyristor is triggered being dependent upon the time constant for the RC circuit consisting of thermistor 2, resistor 3, and capacitor 4. This time constant increases as the resistance of the positive thermistor increases due to current flow through the thermistor during the charging of the capacitor. As the time constant increases, a longer time in each half cycle is required for triggering the Triac on, as illustrated in curve (a) of FIG. 4 and the Triac remains on for a shorter time. The trigger signal produced by element 5 provides a phase control for operation of the Triac, and this phase control triggering signal is provided during both the positive and the negative half cycles of the AC power supply. The current flow through the Triac is cut off during each half cycle when the voltage across the Triac drops below a self-maintaining value.

Figure 4:
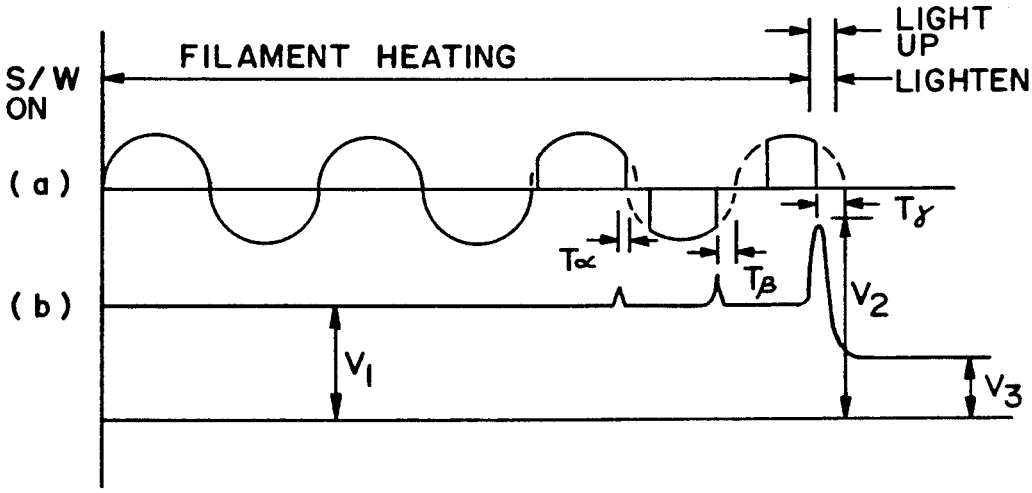
FIG. 4 illustrates diagrammatically in curve (a) the voltage appearing across the Triac of FIG. 2 and in curve (b) the voltage supplied to the filaments of the fluorescent tube in FIG. 3.

As illustrated in curve (b) of FIG. 4, each time the Triac switches off, a self-induced voltage spike is produced across the filaments by the choke coil CH. These reactive voltage peaks increase in amplitude as the phase delay for triggering the Triac increases, until a reactive voltage level $V_2$ is reached which is sufficient to start the discharge of the fluorescent lamp. Thus, as explained above, during each half cycle of the AC source, the starting control circuit operates to trigger the Triac 1 and, when the voltage across the Triac drops below a self-maintaining value, the Triac switches off to produce a reactive voltage spike in the fluorescent tube. As the time constant of the RC circuit gradually increases due to the increasing resistance of the positive thermistor 2, the reactive voltage spikes increase in amplitude, heating the filament until the fluorescent lamp is ignited.

As illustrated in curve (a) of FIG. 4, current is supplied to the Triac from a constant frequency AC source such as a 60 cycle source. When the switch SW is closed, the Triac is triggered during each half cycle of the AC source at a phase determined by the charging of capacitor and the resulting operation of the switching element 5. Before the fluorescent lamp ignites, the current through the circuit is less than the self-maintaining current of the Triac so the Triac cuts off, and this cut off produces the voltage spikes which are illustrated in curve (b) of FIG. 4. After the fluorescent tube discharge has started, the voltage between both ends of the fluorescent lamp decreases to a value $V_3$, which is about one half the original voltage $V_1$, and accordingly the Triac cannot be triggered and remains cut off, so no further triggering spikes are produced. The lamp remains on by reason of a discharge between the filaments. The time constant for the circuit control is established by the voltage between the ends of the fluorescent lamp at terminals Ti and T2, and the values of the positive thermistor 2, the resistor 3, and the capacitor 4 are used as the lamp capacity for the fluorescent tube FL.

Thus, as illustrated in FIG. 4, curve a, the phase control angle ($T_{60}$, $T_{62}$, $T_{65}$) of the AC power is automatically changed during preliminary heating of the filaments and the positive thermistor. The voltage available for starting the fluorescent tube at the point of cut off of the self-maintaining current through the Triac gradually changes, so that it can generate a maximum self-inductance voltage. This circuit provides rapid starting of the fluorescent tube with almost no flickering and with the total elimination of contact point spark noises of the type produced by conventional glow starters.

The circuit of the present invention performs the same function as the conventional glow starter mechanism, but allows the configuration to be smaller and lighter. The circuit of the present invention may be mounted in a container which uses the same socket configuration for connection into the lamp circuit and thus can replace the glow starter in existing fluorescent lamps.

What is claimed is:

1. An electronic starter for fluorescent lamps comprising:

a Triac having a trigger electrode, and having an anode and a cathode connectable to first and second filaments, respectively, of a fluorescent lamp;

a positive thermistor, a resistor, and a capacitor connected in series across said anode and cathode; and a voltage responsive element connected between said trigger electrode and the junction between said resistor and said capacitor.

2. The electronic starter of claim 1 wherein said voltage responsive element is a bipolar Zener diode.

3. The electronic starter of claim 1 wherein said voltage responsive element is a Diac.

4. The electronic starter of claim 1 wherein said voltage responsive element provides a trigger signal to said Triac trigger electrode in response to the voltage on said capacitor.

* * * * *